United States Patent [19]

Chevalier et al.

[11] 4,087,899

[45] May 9, 1978

[54] PRODUCTION OF METAL CASTINGS

[75] Inventors: Claude Chevalier, La Chapelle-sur-Erdre; Raymond Le Diouron, Grenoble; Christian Schoutteten, Saint Herblain; Daniel Le Floch, Lorient; Jean-Pierre Le Bot, Hennebont, all of France

[73] Assignee: L'Air Liquide, Societe Anonyme pour l'Etude et l'Exploitation des Procedes Georges Claude, Paris, France

[21] Appl. No.: 783,315

[22] Filed: Mar. 31, 1977

[30] Foreign Application Priority Data

Apr. 2, 1976 France ..... 76 09701

[51] Int. Cl.[2] ..... B22D 11/12; B22D 31/00

[52] U.S. Cl. ..... 29/527.6; 241/DIG. 37; 164/70

[58] Field of Search ..... 29/527.6; 164/70, 69; 225/93.5; 241/DIG. 37

[56] References Cited

U.S. PATENT DOCUMENTS

| | | | |
|---|---|---|---|
| 1,404,682 | 1/1922 | Barker | 29/527.6 |
| 2,019,727 | 11/1935 | Quinn et al. | 29/527.6 |
| 2,552,029 | 5/1951 | Bludeau et al. | 241/DIG. 37 |
| 2,881,571 | 4/1959 | Granata | 241/DIG. 37 |

FOREIGN PATENT DOCUMENTS

| | | |
|---|---|---|
| 2,164,877 | 7/1973 | Germany. |

*Primary Examiner*—Milton S. Mehr
*Attorney, Agent, or Firm*—Young & Thompson

[57] ABSTRACT

The invention relates to a method of producing sand castings in which a set of castings incorporating the casting runners and risers is formed.

The castings, which are cast in pairs to form compact members, are placed in baskets and are subjected to refrigeration firstly in a precooling zone and then in a dipping zone in a liquid nitrogen tunnel. After this the compact members are placed on a breaking-up table where they are subjected to mechanical shocks to enable the castings to be separated from their casting risers and runners.

Applicable exclusively to "as cast" ductile cast iron.

2 Claims, 4 Drawing Figures

PRODUCTION OF METAL CASTINGS

BACKGROUND OF THE INVENTION

The present invention relates to methods of producing metal sandcastings, in which a set of castings is formed incorporating the casting runners and risers and is then subjected to a separating operation employing mechanical shocks to cause separating fractures at points predisposed to break which are situated at the margins of each casting at the points where the said risers, runners and other connections between the castings are located. Hereinafter such a method will be referred to as "of the kind described".

Methods of the kind described are generally employed with cast iron, and in particular white cast iron which has a structure of, or approximating to, the cementite type which exhibits extreme hardness. In many cases the castings have to be subjected to heat treatment to alter the structure of the cast iron into a structure of the ferritic or ferritic-pearlitic kind characteristic of ductile cast irons such as speroidal graphite cast iron.

To avoid this latter re-treatment operation, efforts have therefore been made to produce "as cast" ductile cast iron directly in the course of the casting operation. To achieve this object, it has been found necessary to control the operation very carefully from the metallurgical point of view by not only making provision for the introduction of additives but also by carefully controlling the rate of cooling.

Although the introduction of additives is an operation which can be managed perfectly well, provided that a great deal of care and experience are employed, the rate of cooling generally has to be sufficiently slow to avoid the formation of a cementite structure and in the majority of cases to obtain the highest possible ferrite content (in the case of cast iron of an average ultimate tensile strength, of the order of 38 kg/mm$^2$), or a minimum pearlite content (in the case of cast iron of considerably higher tensile strength). To this end, it has been proposed to increase the amount of metal cast by providing large risers and by making the casting runners oversize, which slows down the general solidification by virtue of the thermal screening effect which the said risers have with respect to the thermal flux emitted by the casting as it cools. This procedure is not very economical however since it results in a high proportion of rejects, which have to be salvaged, that is to say physically handled and re-melted. This disadvantage is felt all the more severely when the size of the casting is small in relation to the size of the runners and risers since the heat loss remains considerable, whereas the natural mass available to form a thermal store is smaller. For this reason, and also to increase the efficiency with which the mold boxes are used, it has been proposed to arrange the mold cavities for such castings in pairs lying one on either side of the joint plane of the mold with at least one spacing core interposed, and to provide for multiple connecting zones between the two paired castings transversely to the joint plane of the mold, with recesses to form risers provided if required. This ensures a mutual thermal screening effect between the two castings situated facing one another, and also ensures that more intensive use is made of the volumetric capacity of the molding boxes. These advantages are sufficient to cause a preference for this latter method of molding in spite of the disadvantage represented by the need to position a spacing core between the castings, the presence of which is a necessary concomitant of this type of casting.

In comparison with conventional casting, the method of casting articles in pairs is also somewhat disadvantageous as regards the operation of breaking up a set of castings. In effect, in the case of a casting associated with a large riser, the riser comes between the casting runner and the casting and as a result the casting is suspended virtually alone at the end of the casting runner, which means that it is easy to fracture the casting runner close to the casting in the case of hard and brittle cast iron and does not create any major problems in the case of ductile cast iron straight from the mold i.e. "as cast". However, in the case of a set of castings cast in pairs with a large number of runners extending between the two castings in each pair at the points where the multiple connecting zones are situated, the separating operation, which is already laborious with extremely brittle white cast iron, becomes almost impossible with ductile cast iron straight from the mold and, even if it can be achievered with suitable tools, it results in a very substantial reject level as a result of castings breaking and other damage, which makes this method totally prohibitive with cast iron of this nature.

It should also be mentioned that a desperate measure which might have been thought of was cutting by oxygen torch, but is is precisely with "as cast" ductile cast iron that this process cannot be used since it destroys the structure in the neighbourhood of the cut. The only method remaining was apparently cutting by mechanical means, but this method is excessively slow and expensive, particularly in the case of pairs of castings with multiple connections which are very inaccessible to cutters.

It is for this reason that this method of casting has virtually been ignored hitherto despite the clear attractions which it has on a number of counts. It is an object of the invention to overcome or minimise this drawback. Other objects and advantages will become apparent from a study of the description which is to follow.

SUMMARY OF THE INVENTION

In a method of the kind described, the invention consists in the provision of the following steps:

a. the size of the castings is arranged to be small in relation to the molding boxes, and the mold cavities for the said castings are arranged in pairs situated one on either side of the joint plane of the mold, with at least one spacing core interposed, and with multiple connecting zones provided between the two castings making up a pair transversely to the joint plane of the mold, if necessary associated with recesses to form risers; and b. the melted metal is cast iron and the procedure adopted is a known one resulting in "as cast" ductile cast iron;

c. the operation of separation by mechanical shock is preceded by a general cooling of the set of at least two paired castings, in a refrigeration zone which comprises a zone of immersion in a bath of liquid nitrogen preceded by a zone for precooling by means of the vapour of nitrogen so vaporised, said general cooling operation continuing for just long enough for the embrittlement temperature of the cast iron to be reached at the points where the break points are situated, after which the said operation of separation by mechanical shock takes place on the spot.

The extreme effectiveness of the method has been demonstrated by experiment: the metal, which becomes brittle at the break points, fractures easily, simply by being struck on a metal table. Furthermore, the relatively low temperature to which the metal is brought is not prejudicial to the preservation of the structure which the cast iron has at the end of the solidifying operation.

In fact, the principal characteristics of the cast iron are preserved, in particular its ductility, and there is no need for any subsequent heat treatment. Because of the large number of connections, which are pre-disposed to fracture, between the casting making up a pair on the one hand, and between the risers and the castings on the other, the cross-sectional dimensions of these connections may be relatively small and may in all cases very much smaller than the diameter of the risers, with the result that the cooling, even when applied generally and to parts of relatively small dimensions, is still fairly selective, given that, because of the rapidity of the drop in temperature and the relatively poor thermal conductivity of cast iron, the only zones deeply affected are in fact the connecting zones which are to be pre-disposed to fracture, which is doubly beneficial both from the economic point of view and from the point of view of preserving the physical properties of the metal.

We are aware of the fact that ferrous metals are known to become brittle when brought to very low temperatures, but the principal application which has so far been made of this fact is so specialised and so different from the present invention that no comparison can be made. What have in fact been proposed and produced are installations for breaking up compacted blocks, such as car bodies, which is done by making all the iron present, which predominates, brittle before subjecting the said blocks to the action of a crusher, the power of which can be considerably reduced in this way.

This application of the embrittling of metals at low temperature is one which differs from the present application for several reasons, chief among which are the following:

— the aim is very different: in the known application, what is involved is breaking up scrap iron and other materials into small pieces which can then be sorted magnetically. What is presently involved is simply and solely a technique for casting articles, which is far removed from the salvaging of various metals.

— although the means employed are substantially similar, since in both cases they involve a liquid nitrogen refrigeration tunnel or the like, their functions are different: in the known application, it is a question of cooling a pre-compacted block of scrap iron to its core and the whole mass of metal has to be brought to the embrittling temperature. In the case of the invention on the other hand, the set of castings is cooled differentially and the only portions which are cooled right through are the thinnest portions and in particular the connections which are to be pre-disposed to fracture.

— despite a certain similarity in the means of refrigeration employed between the known application and that according to the invention, the problem of removing the risers from sets of paired castings made of "as cast" ductile cast iron has existed in the technical casting field for many years yet it has not occurred to any engineer that in a particular technique for casting a special cast iron, cryogenic embrittling might usefully be employed. It has certainly not been mere economic considerations connected with the cost of refrigeration which have been behind the rejection of this cryogenic embrittling techque since firstly the cost of the refrigerant has not altered to any substantial extent for many years and secondly any such conclusion could in fact only have been reached after trials and no such trials have been made public and even if they had been conducted these trials, which must obviously have been unsuccessful since no actual use followed, in contrast to the conclusions reached by us, would have been carried out either with casting techniques or with types of cast iron different from those to which the present invention relates, which would thus probably have been unsuited to the cryogenic treatment described.

BRIEF DESCRIPTION OF THE DRAWINGS

The invention will now be described with reference to the accompanying drawings, in which.

DETAILED DESCRIPTION OF PREFERRED EMBODIMENTS

Figure 1:
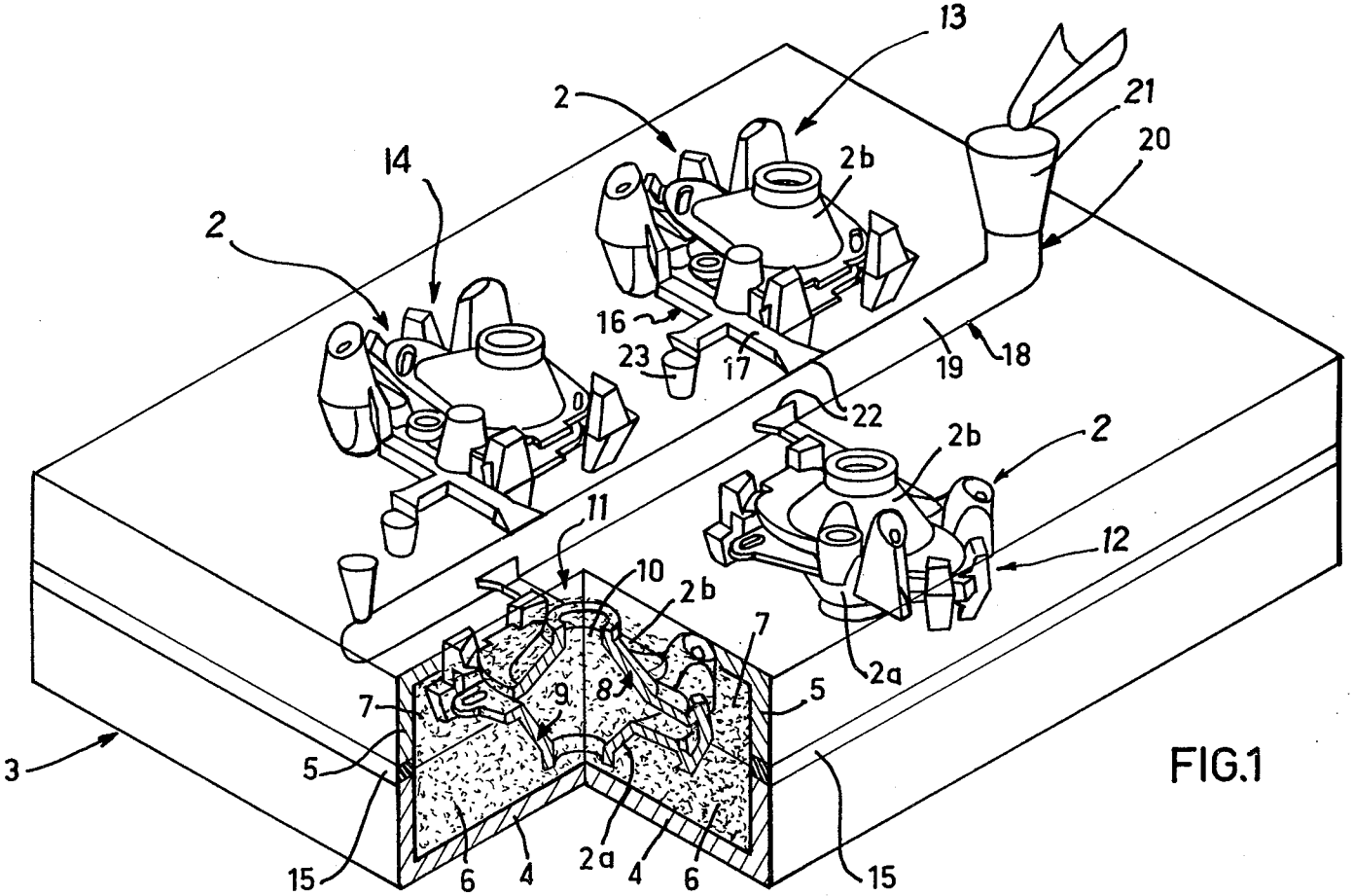
FIG. 1 is a schematic perspective view of a set of castings still in the mold.
Figure 2:
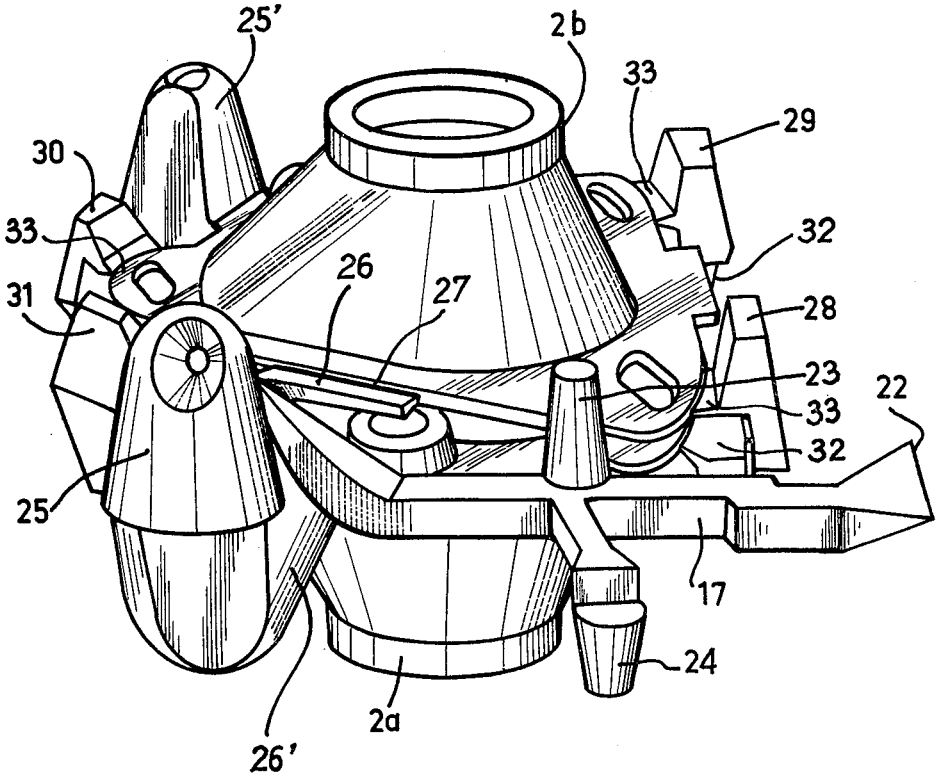
FIG. 2 is a perspective view from above of a pair of castings.
Figure 3:
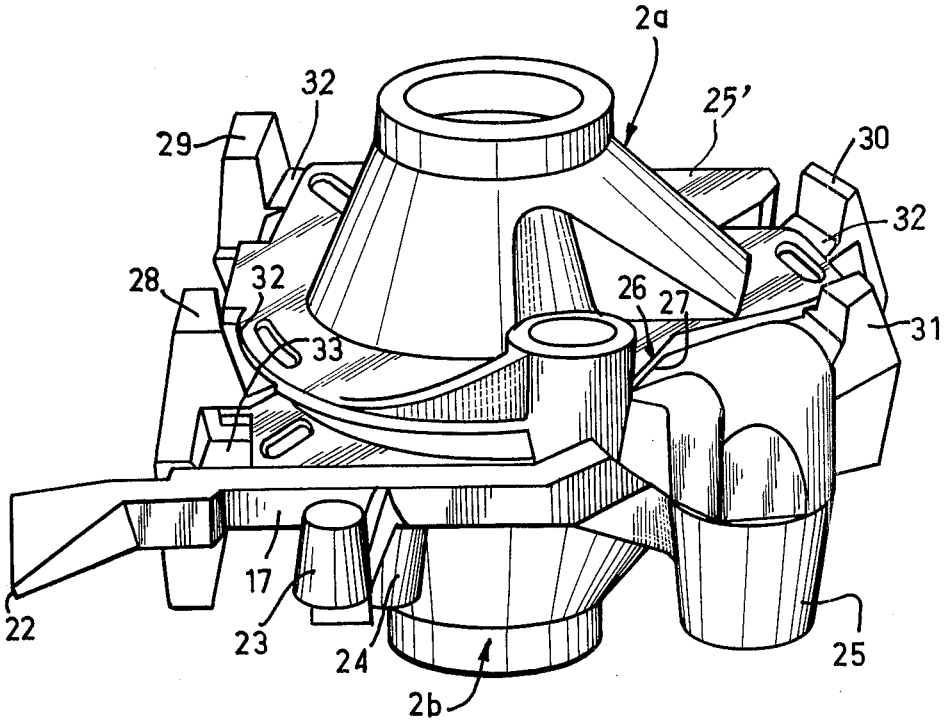
FIG. 3 is a perspective view of the same pair of castings seen from below.
Figure 4:
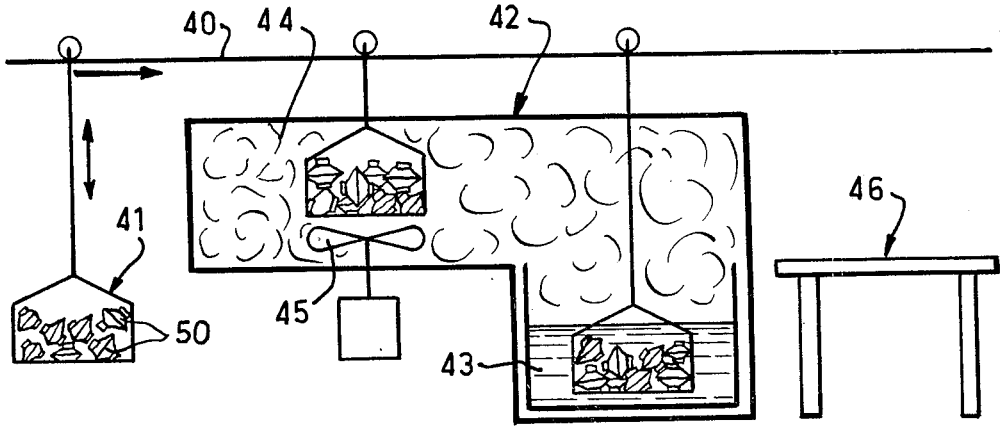
FIG. 4 shows a schematic view of the plant for practising the invention.

Referring to FIGS. 1 to 3, a set of castings 2 is cast in a mold 3 consisting of a bottom box 4 and a top box 5, the two of which contain sand matrices 6 and 7. In these matrices are formed mold cavities 8 and 9 between which are placed one or more spacer cores 10 to provide a separating space between the two castings 2*a* and 2*b* forming each of four pairs of castings 11, 12, 13 and 14. The mold cavities 8 and 9 thus allow casting to take place in such a way that one 2*a* of the castings in any pair 11 to 14 is situated on one side of the joint plane 15, in the bottom box 4, while the other casting 2*b* in the same pair 11 to 14 is situated facing the casting 2*a* on the other side of the joint plane 15, in the top box 5. Each pair of castings 2*a*, 2*b* is fed by a branch channel 16 which forms a branch runner 17 from a main feed channel 18. The main feed channel 18 forms a main runner 19 which is fed by a vertical channel 20 forming a feed runner 21, the arrangement being such that the main runner 19 is connected to each of the branch runners 17 by a break point 22.

Risers are formed at various points along the path of flow of the metal. By way of example, two risers 23 and 24 can be seen which are formed in the one case at an upper point of branch runner 17 and in the other at a lower point, as also can two large risers 25 and 25' which are joined to the margins of castings 2*a* and 2*b* by an upper connection 26 (casting 2*b*) and a lower connection 26' (to casting 2*a*), these two connections each having a break point 27 along the margins of castings 2*a* and 2*b*. Similarly, smaller risers 28, 29, 30 and 31 are formed at various other points around the margins of castings 2*a* and 2*b* and each have two connections, with break points 32, 33, to castings 2*a* and 2*b*.

Once the cast iron of spheroidal graphite type has solidified and cooled sufficiently, removal from the mold may take place. The set 1 can be broken at the break points 22 into an appropriate number of pairs 11, 12, 13 and 14 without too much difficulty, thus forming compact members 50 of which one is shown in FIG. 2 after being freed from the main runner 19 and the feed runner 21. These members 50 are placed in openwork baskets 41 suspended from a conveyor 40 so as to be passed into a refrigeration tunnel 42 which has a downstream section 43 forming a trough for liquid nitrogen and an upstream section 44 forming a prerefrigeration zone containing nitrogen vapour which is kept in motion by a fan 45. By means which are not described and which are means for adjusting the height of the baskets 41 from the conveyor 40, the baskets are successively conveyed into the pre-refrigeration zone 44, and then into the dipping zone 43 for a brief period which naturally depends on the size of the castings and in particular on the size of the connections between the castings 2*a* and 2*b* and between the risers and the castings 2*a* and 2*b*. The dwell time in the pre-refrigeration zone 44 is generally a few minutes while the period of the dipping into the liquid nitrogen at 43 is from one to three minutes. After this the baskets are taken to a breaking up table 46 on which the various compact members 50 are subjected to mechanical shocks to break the connections between the branch runners 17 and the castings 2*a* and 2*b*, between the castings 2*a* and 2*b*, and between the risers and the castings 2*a* and 2*b*. Manual methods or suitable percussions tools may of course be used to perform the operation of separation by shock.

The invention applies exclusively to the casting in pairs of casting made of "as cast" ductile cast iron.

We claim:

1. In a method of producing cast iron sand castings, comprising forming a set of castings incorporating casting runners and risers, subjecting said castings to mechanical shock to cause separating fractures at the margins of each casting at the locations of said runners and risers; the improvement comprising a. arranging the castings to be small in relation to a molding box, arranging the cavities for molding said castings in pairs one situated on either side of a joint plane of the mold with at least one spacer core interposed and with multiple connecting zones between said castings forming a pair of castings transverse to the joint plane of the mold, b. casting molten iron in said cavities to produce ductile cast iron in the as-cast condition, c. prior to said subjection to mechanical shock, cooling said paired castings in a refrigeration zone by immersion in a bath of liquid nitrogen preceded by precooling with vapor of nitrogen thus vaporized, continuing said cooling for just long enough for the embrittling temperature of the cast iron to be reached at the points where said runners and risers break from the castings, and then performing said operation of subjection to mechanical shock in situ.

2. A method as claimed in claim 1, and in step (a) providing recesses to form said risers.

* * * * *